US006145728A

United States Patent [19]

Marks

[11] Patent Number: 6,145,728

[45] Date of Patent: Nov. 14, 2000

[54] COMPACT SIMPLIFIED STAPLE GUN MECHANISM

[75] Inventor: Joel S. Marks, Sherman Oaks, Calif.

[73] Assignee: WorkTools, Inc., Chatsworth, Calif.

[21] Appl. No.: 09/299,209

[22] Filed: Apr. 26, 1999

[51] Int. Cl.[7] ..... B25C 5/06

[52] U.S. Cl. ..... 227/132; 227/120

[58] Field of Search ..... 227/132, 134, 227/120, 125, 126

[56] References Cited

U.S. PATENT DOCUMENTS

| | | | |
|---|---|---|---|
| 3,149,339 | 9/1964 | Johnson . | |
| 4,452,388 | 6/1984 | Fealey | 227/132 |
| 4,629,108 | 12/1986 | Judge | 227/132 |
| 5,497,932 | 3/1996 | Brewer et al. | 227/132 |
| 5,664,722 | 9/1997 | Marks | 227/132 |
| 5,765,742 | 6/1998 | Marks | 227/120 |
| 5,810,470 | 10/1998 | Plato et al. | 227/132 |

FOREIGN PATENT DOCUMENTS

| | | |
|---|---|---|
| 0281541B1 | 5/1991 | European Pat. Off. . |
| 2477458 | 9/1981 | France . |
| 2032327A | 10/1979 | United Kingdom . |

*Primary Examiner*—Scott A. Smith
*Attorney, Agent, or Firm*—Brad I Golstein

[57] ABSTRACT

A compact simplified staple gun mechanism is disclosed. The invention provides an improvement to conventional staple guns and particularly to a forward action type staple gun. A compact high efficiency reset spring applies force in selected directions depending on the position of an actuating lever in the reset cycle. The lever and power spring engage a plunger through multiple proximate openings in the plunger while retaining a strong compact configuration. The lever and power spring are partially nested in each other and pivot about a common post of the housing. The above combined features provide a high efficiency compact staple gun tool.

3 Claims, 4 Drawing Sheets

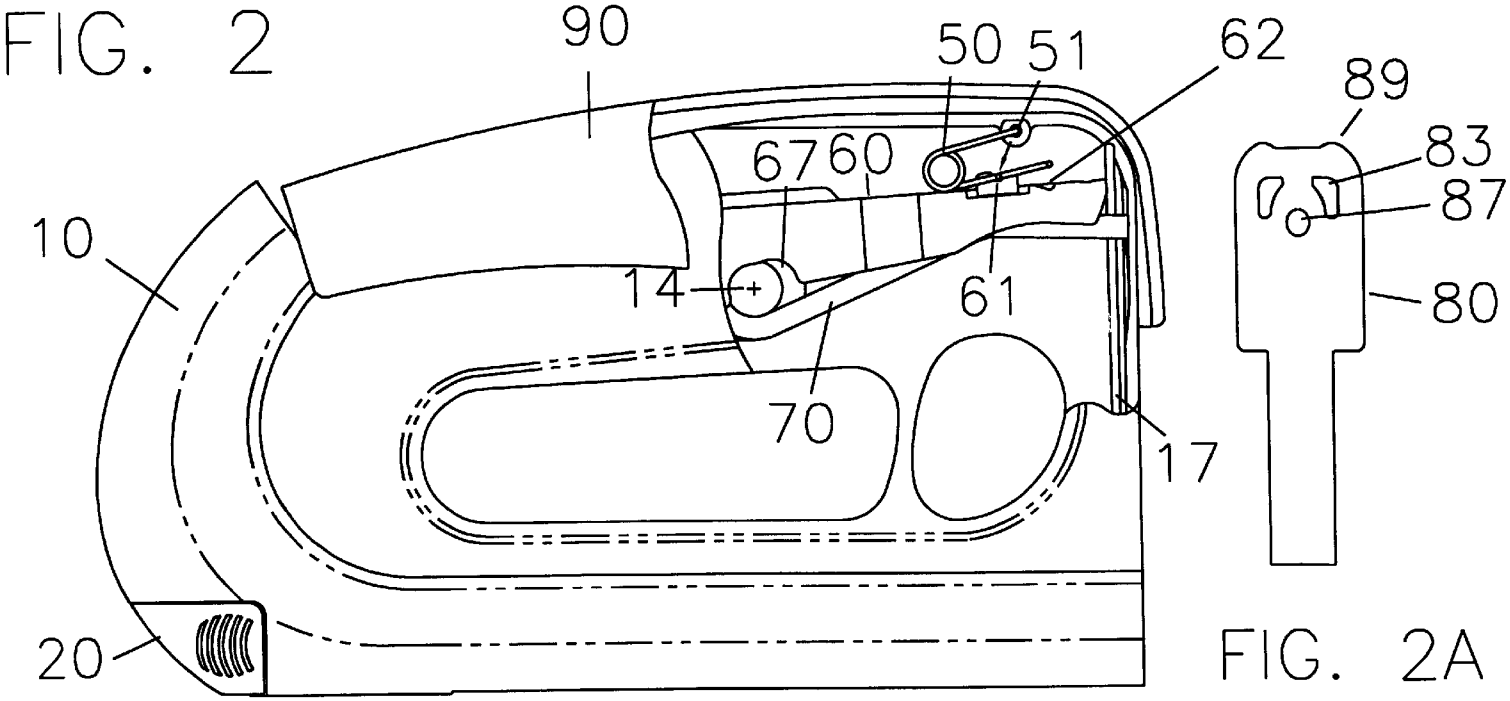
FIG. 2
FIG. 2A
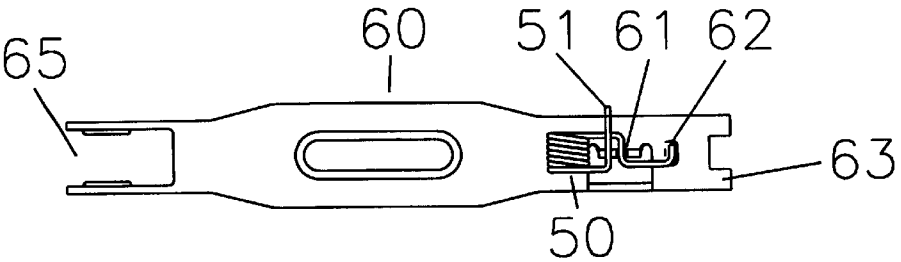
FIG. 3

COMPACT SIMPLIFIED STAPLE GUN MECHANISM

FIELD OF THE INVENTION

The present invention relates to fastener driving tools. More precisely, the present invention relates to improvements in a compact simplified staple gun mechanism.

BACKGROUND OF THE INVENTION

The present invention discloses an improved method to reset the plunger raising lever in a spring actuated device such as a staple gun. The present invention is particularly directed to an improvement of the function of a compact reset spring in a typical type of staple gun mechanism. The present invention further discloses a compact plunger and lever design.

In this type of mechanism an actuating lever pivots in a housing to raise a plunger. The plunger typically but not necessarily comprises a simple flat form. The front end of the lever engages an opening in the flat plunger to raise the plunger. At a predetermined point in the rotation of the plunger the lever front end arcs out of the plane of the plunger to free the plunger to be forcibly moved downward by the action of a power spring.

To reengage the opening in the plunger the lever must rotate downward and translate rearward to pass behind the plunger. The lever must finally translate forward into the plunger opening. The reset action is controlled by a reset spring.

French patent 2477-458 shows a typical staple gun mechanism. The reset spring 23 comprises a substantially vertically oriented compression spring pressing the front of the lever. The spring provides a downward and slight forward bias to the front end of the lever.

U.S. Pat. No. 5,765,742 shows a light duty forward action staple gun. The reset spring is a compression spring above the front end of the actuating lever similar to that of French 2477-458.

UK patent 2032327 shows a substantially identical mechanism to French '458, except that reset spring 12 is an extension type mounted such that it pulls the lever strongly forward and, almost indirectly, the front end downward.

European patent 0281541 shows a somewhat different mechanism from the previous two. Reset spring 15 is identical to that of French '458, specifically a downward and slightly forward pressing compression spring.

U.S. Pat. No. 3,149,339 shows a more complex mechanism where the lever engages the plunger indirectly. Reset spring 49 is a torsion spring wrapped around post 51. The reset spring also functions to bias the plunger engagement.

The reset mechanisms described above are typical of the prior art. They are either too complex or of limited effectiveness. Of particular relevance are the three European patents using the simplified lever. Although such mechanisms are easy to manufacture they do not provide reliable function. In the case of the downward acting compression spring the lever front end readily moves rearward of the plunger and downward. But since the forward bias is gentle, the re-engagement action is weak. In use the lever may prematurely disengage the plunger since the reset spring may not have adequately translated the lever forward into the opening in the plunger. Empirical observation has shown this re-engagement to be weak.

In the case of the forward pulling extension spring the engagement bias is more than adequate. However the downward bias on the lever front end is weak. The lever is prone to hanging up on the top edge of the plunger.

In an optimum design the lever front end is not pressed forward at all through most of the reset motion. In fact a rearward bias to the lever would be desirable. After the lever front end is lowered past the top edge of the plunger a forward bias should occur. The lever then slides smoothly along the rear surface of the plunger and firmly moves forward to engage the opening in the plunger.

A further liability of the above references is that they cannot be vertically compact and sturdy at the same time. The three European references are typical of the prior art wherein the actuating lever front end is substantially spaced above the spring front end. For example in British '327 opening 7 is well above opening 10 along the plunger. US '742 has two vertically separated openings in the plunger with a rib between them. The rib is prone to breakage and must be especially thin if the power spring and actuating lever are nested closely together.

A design using a compact efficient reset spring combined with a vertically short plunger will facilitate a short compact tool housing when used in a conventional rearward action staple gun. When such elements are incorporated into a forward action staple gun as shown in the Figures a compact mechanism is especially helpful to maintain a reasonable hand grip distance. Vertical compactness is particularly important in a heavy duty format staple gun where the travel of the plunger and size of the components are relatively large.

SUMMARY OF THE INVENTION

In the present invention a reset spring abruptly changes its direction of bias at a particular position of the lever reset cycle. When the lever front end is in an upper position the spring presses downward and preferably slightly rearward upon the lever front end. When the lever front end is near its most downward position the spring presses downward and distinctly forward.

The reset spring is a torsion type, preferably not confined about a mandrel. A mandrel free torsion spring is especially efficient in confined spaces since it expands purely outward between two pivoting endpoints. The resulting geometry allows a relatively constant force as the spring is deflected. The expanded spring acts as a wedge using two spread arms. The outward force is created tangentially to the rotation of the spring itself so the outward force is great. When the spring is contracted the rotation force is directly between the pivot points. So although the torsion force decreases as the spring expands, the net outward force remains relatively constant.

In contrast a spring such as that of the prior art provides unnecessarily high resistance when it is most deflected. The force of the reset spring adds to the force of the power spring. An excessively strong reset spring is necessary to ensure a reliable engagement action in the prior art.

To change the force direction the pivot points described above shift as the spring angle changes. As the spring expands a further out part of at least one arm makes contact with a further out pivot point. The initial inward pivot point lifts from its contact to move freely as part of the arm of the spring. Other spring configurations may achieve the same result. For example various types of springs could be used where an element of the spring touches a further element of the mechanism to bias the spring forward or rearward depending on the amount the spring is extended.

To compliment the compact reset spring, a compact plunger is shown. The actuating lever and power spring engage the plunger at nearly the same vertical location along the plunger. A total of three main openings are provided in the plunger. Two openings toward each side of the plunger link with a pair of extensions of the lever at the lever front end. A third opening for the power spring is between and slightly below the two openings. The spring opening is surrounded by a rib structure connecting the plunger top end to the material below. The result is that the openings are immediately proximate to each other while the plunger retains its mechanical integrity. Additional openings may be desired, such as two spring openings and four lever openings. A feature of the invention is that a reinforcing rib structure surrounds related openings in the plunger.

The power spring may comprise a torsion, flat or other type of spring. The power spring pivots about the same post or similar structure as pivots the actuating lever. In this way the mechanism of the invention remains compact. Further the net force on the post is minimized since the downward force from the lever is opposed by a similar upward force from the power spring. The post will not cause large stresses upon ther housing body. This is especially helpful when the housing is constructed of plastic material.

BRIEF DESCRIPTION OF THE DRAWINGS

FIG. 2 is the staple gun of FIG. 1, in a fully energized position as it appears just before release of the plunger and power spring.

FIG. 2A is the plunger of FIG. 1A, in a raised position.

FIG. 3 is a top elevation of an actuating lever with a reset spring positioned above the lever.

DETAILED DESCRIPTION OF THE ILLUSTRATED EMBODIMENT

Figures 1, 1A:
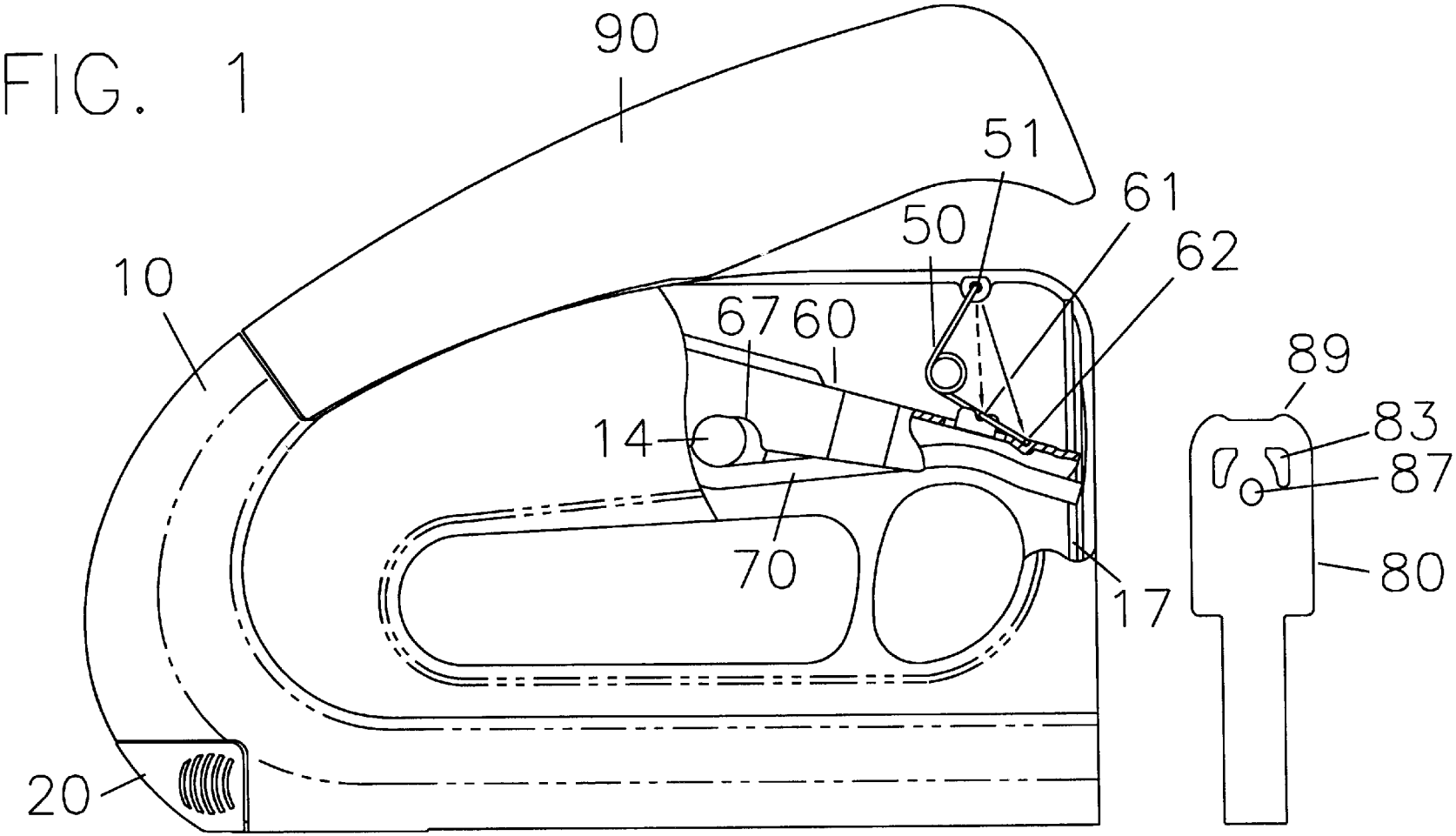
FIG. 1 is a side elevation partly in section of a staple gun showing a reset mechanism in an initial condition.
FIG. 1A is a plunger shown separately in plan view rotated 90° about its long axis from its normal position in the assembly.

In the Figures a forward action staple gun is shown. Actuating lever 60 serves as a means to link handle 90 to plunger 80. Lever 60 is linked to handle 90 preferably by means of roller 100, fitted at the rear of lever 60. A sliding contact would also serve a linking function. So while the disclosed mechanism benefits the forward action staple gun shown, the same benefits apply to any staple gun or similar device using a mechanism that functions as described herein.

Housing 10 contains and guides the elements of the staple gun. In the initial condition of FIG. 1 the forward end of lever 60 engages lever openings 83 of plunger 80. Lever openings 83 may also be formed as equivalent recesses in the rear face of plunger 80 rather than as through holes. Lever 60 has a "U" shaped cross section with a substantially flat top and downward extending sides. In the illustrated embodiment the forward end of the lever comprises two distinct extensions 63 seen in FIG. 3, where extensions 63 comprise "L" shaped portions of the lever cross section. Extensions 63 engage lever openings 83 in plunger 80. To reduce wear lever openings 83 and extensions 63 have substantial horizontal engagement, and most importantly disengagement, surface. The wide engagement surface is due to the "L" shape section of extensions 63. While lever openings 83 are wide at the top these openings are narrow at the bottom where spring opening 87 is located. The lower part of lever opening 83 can be narrow since only the slim vertical walls of extension 63 need fit there. In an alternate embodiment extensions 63 could have the slim vertical portion only. Then lever openings 83 could also be narrow vertical slots. However the correspondingly small disengagement surface would be more prone to wear. Narrow slots are also more difficult to manufacture since thin punch dies are more easily broken.

The configuration described above retains a sturdy structure around spring opening 87 while the spring and lever engage the plunger quite close to each other. The sturdy structure enables the plunger to resist impact forces during use.

A further feature of the compact mechanism of the present invention is the high efficiency of reset spring 50. Reset spring 50 pivots about two of three pivot points. Housing pivot 51 is fixed. Only one of lever pivots 61 and 62 are selected. In the illustrated embodiment lever pivots 61 and 62 are notches. Vertically elongated slots would also function. The requirement is that reset spring 50 can pull away from the lever pivots. Arrows extending away from housing pivot 51 indicate the direction of force provided by reset spring 50.

In the initial condition shown in FIG. 1 lever 60 is in a forward position engaging plunger 80. For clarity plunger 80 is omitted from the assemblies in the Figures and is instead shown in its relative vertical position but in a plan view. Channel 17 within housing 10 normally guides plunger 80. Slot 67 can be seen in the forward position over housing post 14. Slot 67 is open at the bottom in contrast with the typical prior art where the equivalent slot is fully enclosed. An enclosed slot would also function in the present invention, but would be less compact. A bump atop lever 60, above slot 67, serves to stiffen the structure.

In FIG. 1 two reset spring force arrows are shown. The solid arrow shows the present force direction. The dashed arrow shows the force direction that occurs earlier in the reset cycle. In the initial condition of FIG. 1 reset spring 50 is pushing lever 60 forward into plunger openings 83. The lower distal end of spring 50 is pressing lever 60 at pivot 62. In the illustrated embodiment pivot 62 is an indentation in the top of lever 60. An intermediate portion of reset spring 50 passes over pivot 61. Although spring 50 appears quite near to pivot 61 in FIG. 1, there is no contact at pivot 61. The distance between reset spring 50 and pivot 61 is even greater, as a result of rotation of reset spring 50 about pivot 51 and pivot 62, if lever 60 were translated rearward, not shown, as it would be just before lever 60 slides into openings 83.

In FIG. 2 the lever forward end is raised to a maximum height. It is clearly visible that spring 50 is pivoting about pivot 61. The lower arm of reset spring 50 has rotated such that the distal end of spring 50 is spaced above pivot 62. The force direction arrow points rearward. Before the release of plunger 80 the force of power spring 70 overwhelms the effect of spring 50. After the release of plunger 80 lever 60 is in substantially the same position. Reset spring 50 now controls the action of lever 60.

Figures 4, 4A:
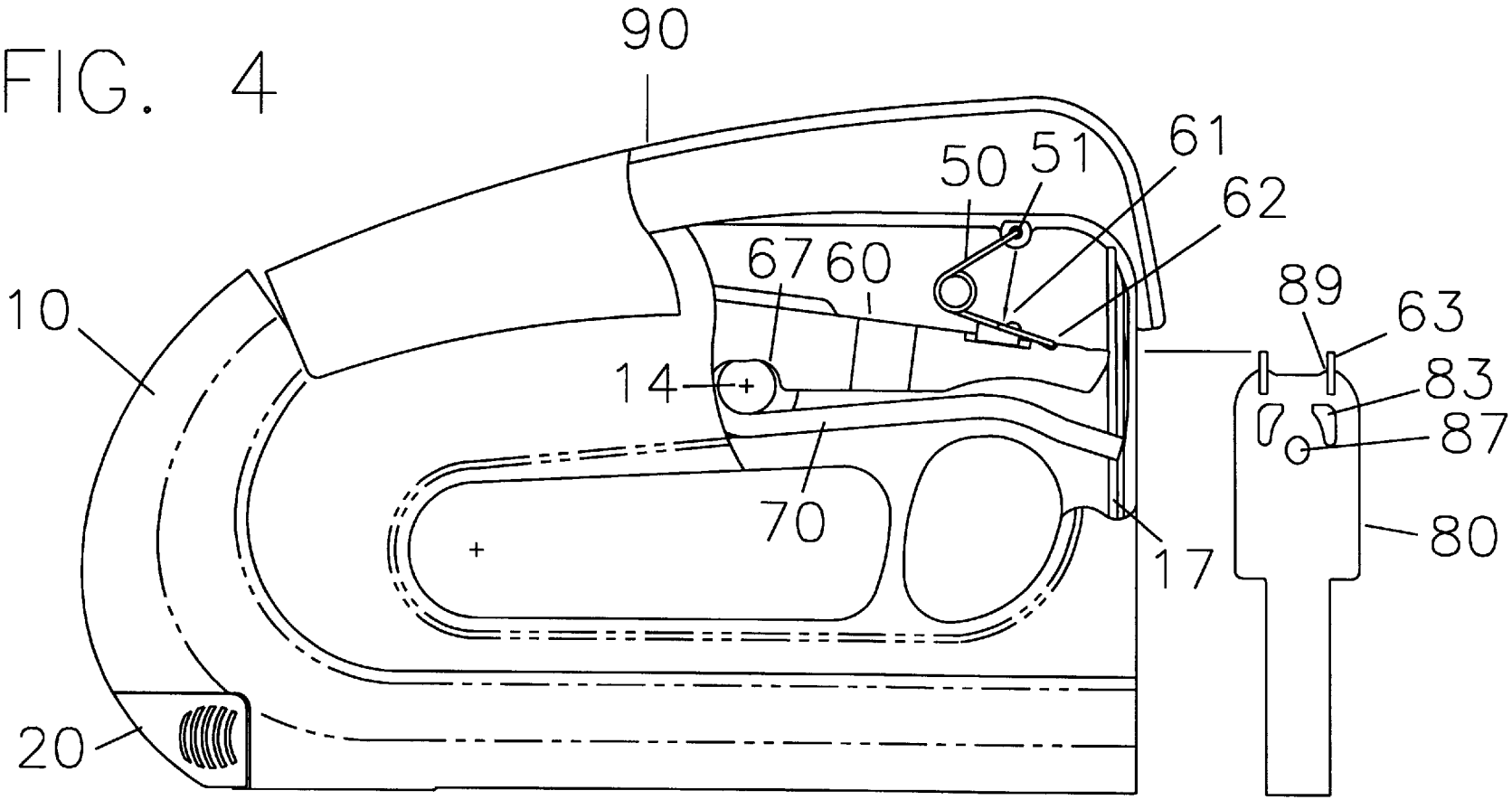
FIG. 4 is the staple gun of FIG. 2, where the mechanism is in an intermediate reset position.
FIG. 4A is the plunger of FIG. 1A, with a lever front end section.

As handle 90 and the rear end of lever 60 are raised the mechanism is in the configuration of FIG. 4. Lever extensions 63 are contacting plunger top end humps 89 as they pass below and behind the top of plunger 80. Plunger top end humps 89 are slightly extended up so that only the vertical side of extension 63 contacts the top edge of plunger 80. The horizontal top portion of extension 63 is held away from the top edge of plunger 80. If these horizontal portions of 63 were to contact the plunger top edge, lever 60 would likely become stuck near the position shown in FIG. 4. In FIG. 4 the force arrow points slightly rearward. Reset spring 50 pivots about pivot 61. As in FIG. 1, the spring distal end is adjacent to but not contacting pivot 62. It can be seen that pivot 61 is higher on lever 60 than is pivot 62. Although the lever pivots could be designed at the same level on lever 60, this would require that the reset spring lower arm have an out of plane bend to provide a correct geometry. This would complicate manufacture of the spring.

The general concept is that pivot 61 is rearward of housing pivot 51, and pivot 62 is forward of pivot 51. Hence an expanding force between pivots 51 and 61 has a rearward element, while a similar force between pivots 51 and 62 has a forward element.

As visible at lever slot 67, lever 60 is translated rearward in FIG. 4. The rearward bias to cause the rearward motion must be strong enough to overcome friction. Lever 60 slides atop post 14 at slot 67. Lever 60 also slides at the top edge of plunger 80. The vertical sides of extensions 63 are angled in a conventional manner to help lever 60 slide rearward. This is the only means to translate the lever rearward in the prior art staple guns. In the present invention the reset spring assists in the sliding action, since reset spring 50 directly adds a rearward bias to lever 60. Even if reset spring 50 merely pressed lever 60 directly downward it would be an improvement over the prior art. The conventional reset springs all add a forward bias to the lever through the entire motion. In that case the interaction between the angled lever front end and the top of the plunger is in conflict with the forward force caused by the reset spring.

A further feature of the present invention is the arrangement of power spring 70 and lever 60 about post 14. Power spring 70 is a heavy torsion spring for which post 14 serves as a fulcrum securing point. Preferably multiple coiled turns of the spring surround post 14. Lever 60 rests atop the same post 14 at lever slot 67. Portions of power spring 70 are nested within the "U" channel of lever 60. Lever 60 creates a downward force upon post 14, while power spring 70 causes an upward force. These opposing forces substantially cancel each other resulting in greatly reduced stress upon post 14. The sharing of post 14 also contributes to the compact design of the present invention since only one such post must be accomodated. Lever 60 remains compact since only one opening is needed to fit a post. A second post, to support spring 70 for example, would require additional recesses or openings in lever 60. Lever 60 would then need to be larger in at least the area of the second opening to remain strong.

Figures 5, 5A:
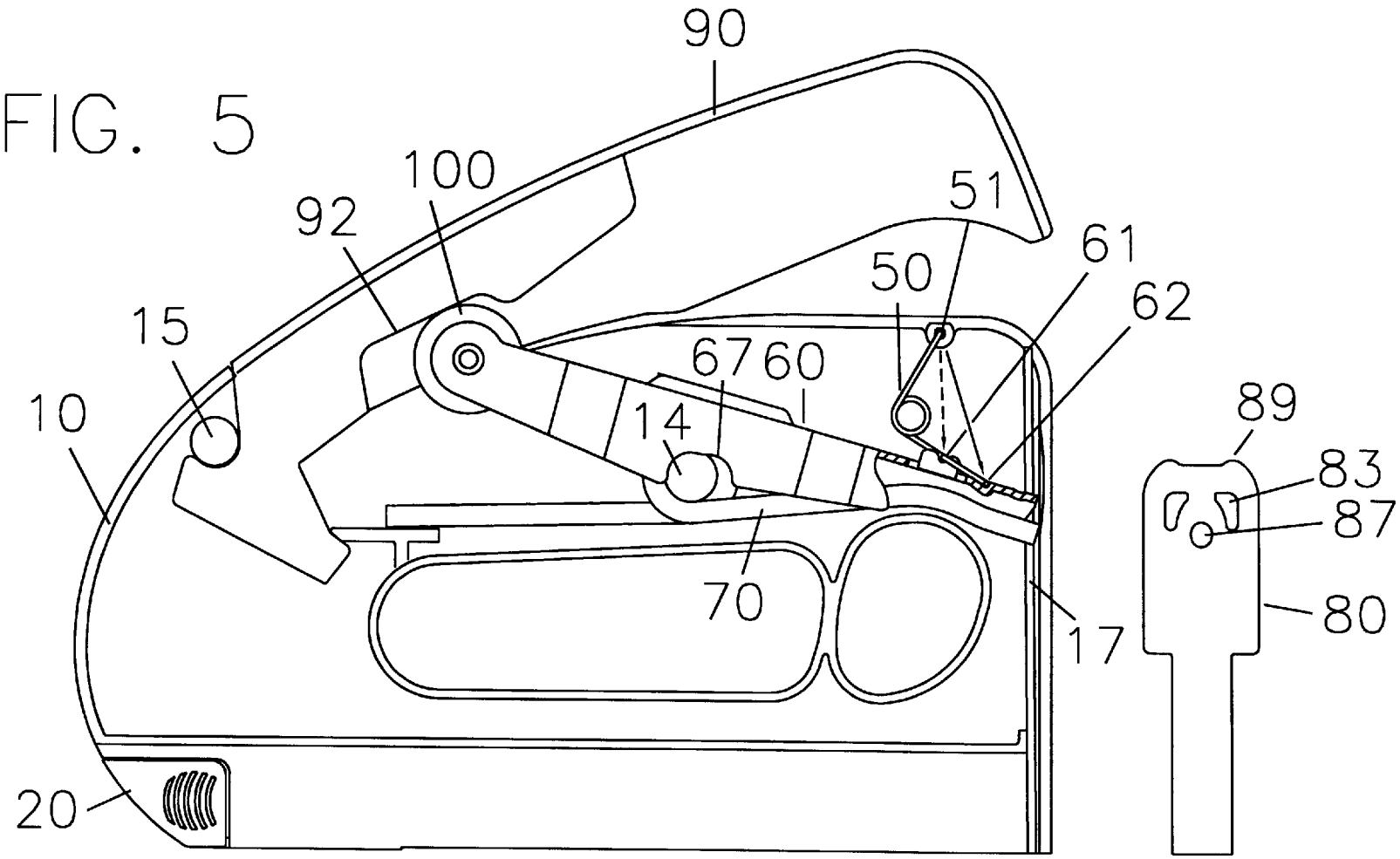
FIG. 5 is the staple gun of FIG. 1, where a cover side of the housing is entirely removed to show a flat power spring.
FIG. 5A is the plunger of FIG. 1A, with a square spring opening.
Figures 5, 5A:
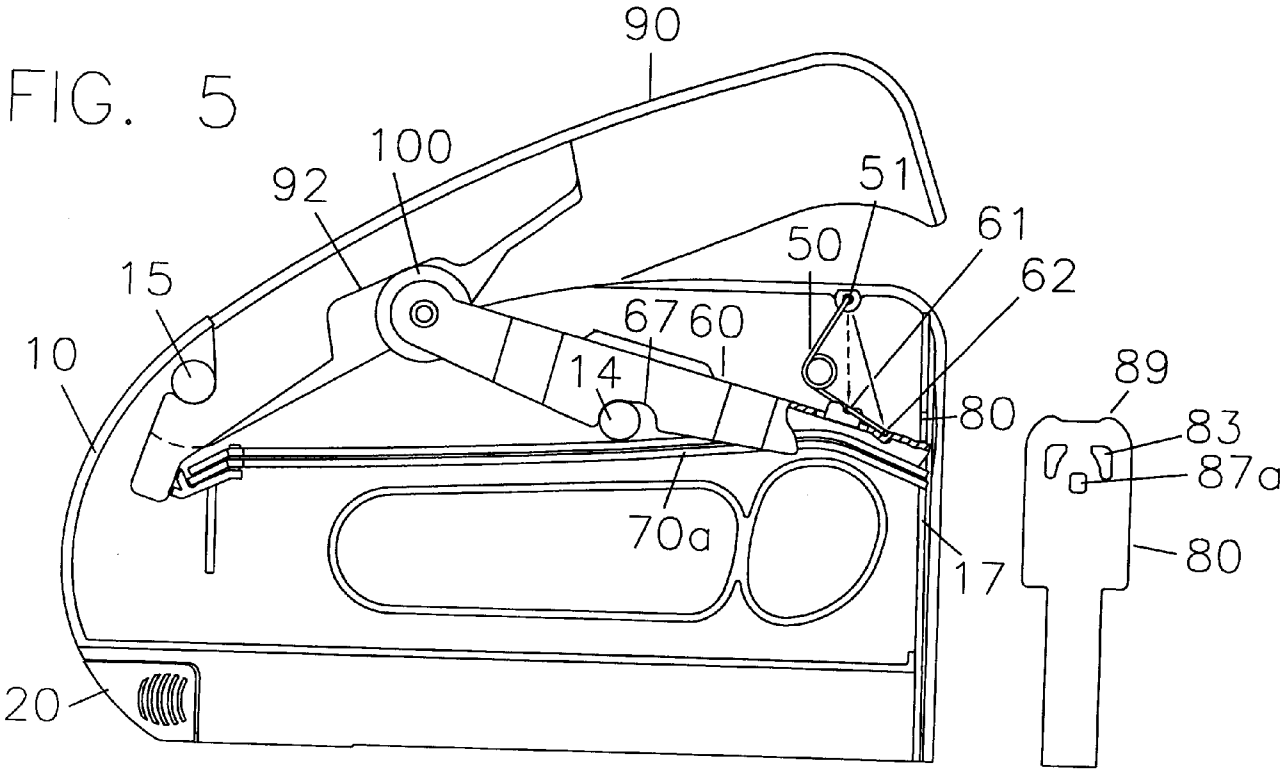

FIG. 5 shows an alternate embodiment of the invention where power spring 70*a* is a flat spring rather than a coiled torsion spring. Two springs 70*a* may be stacked together as shown. Preferably flat springs 70*a* are tapered in width, not shown, being narrow at each end and widest near post 14. Like coiled spring 70, flat spring 70*a* pivots about post 14. The relatively narrow front end of flat spring 70*a* fits within the confines of the front end of lever 60 as shown, in a similar way as in FIG. 1 for coiled spring 70. The front distal end of flat spring 70*a* engages spring opening 87*a* of plunger 80. Opening 87*a* is preferably partially rectangular to best fit a flat spring.

FIG. 5 shows means to link handle 90 to the mechanism of the tool. Wheel 100 is rotatably attached to a rear end of lever 60. Wheel 100 rolls along surface 92 within handle 90. Handle 90 rotates about pivot 15 of housing 10.

Track pull 20 is attached to a staple feeding track within a chamber of housing 10, not shown, to feed staples to the front of the chamber. Plunger 80 ejects staples from the front of the chamber.

Although the present invention has been described in a preferred embodiment, modifications may be anticipated without departing from the spirit and scope of the invention as claimed herein.

What is claimed is:

1. A fastening tool to install fasteners by impact blow comprising:

a housing body including a front, a rear, a top and a bottom;

a fastener guide track attached to the housing near the bottom thereof, to guide fasteners toward the front of the housing;

a plunger located at the front of the housing, the plunger oriented to expel objects at a front of the fastener guide track out of the fastening device;

a spring fulcrum post within the housing;

a power spring linked to the plunger, oriented to force the plunger toward the bottom of the housing, wherein the spring is elongated and extends from at least one spring opening in the plunger toward the rear of the housing, and the power spring pivotably presses the fulcrum post;

an actuating lever linked to the plunger and rotatably linked to the housing at the spring fulcrum post so that rotation of the actuating lever about the spring fulcrum post lifts the plunger within a channel of the housing, wherein the channel is disposed above the front of the fastener guide track.

2. The fastening device of claim 1, wherein the actuating lever has a "U" shaped transverse cross section forming an elongated cavity, and a portion of the power spring resides inside the cavity.

3. The fastening device of claim 1, wherein a handle is pivotably attached near the rear of the housing body at a handle first end, a handle second end is positioned over the front of the housing body, and the lever is linked to the handle at a location between the handle first end and the handle second end.

* * * * *

UNITED STATES PATENT AND TRADEMARK OFFICE

CERTIFICATE OF CORRECTION

PATENT NO. : 6,145,728
DATED : November 14, 2000
INVENTOR(S) : Joel S. Marks

It is certified that error appears in the above-identified patent and that said Letters Patent is hereby corrected as shown below:

Drawings,
Delete Sheet 4 of 4 and substitute Sheet 4 of 4 as shown on the atached page.

Signed and Sealed this

Twenty-eighth Day of January, 2003

JAMES E. ROGAN
*Director of the United States Patent and Trademark Office*